US006252555B1

(12) United States Patent
Burton

(10) Patent No.: US 6,252,555 B1
(45) Date of Patent: Jun. 26, 2001

(54) ANTENNA CLIP FOR ELECTRONIC COMPONENTS

(76) Inventor: John E. Burton, 707 W. Court St., Ludington, MI (US) 49431

( * ) Notice: Subject to any disclaimer, the term of this patent is extended or adjusted under 35 U.S.C. 154(b) by 0 days.

(21) Appl. No.: 09/471,896

(22) Filed: Dec. 23, 1999

(51) Int. Cl.[7] ..... H01Q 1/24
(52) U.S. Cl. ..... 343/702
(58) Field of Search ..... 343/702; 455/90; H01Q 1/24

(56) References Cited

U.S. PATENT DOCUMENTS

| | | | |
|---|---|---|---|
| D. 386,298 | 11/1997 | Hancock | D3/218 |
| D. 401,930 | 12/1998 | Scalisi et al. | D14/144 |
| 4,506,426 | 3/1985 | Booker | 29/413 |
| 4,536,925 | 8/1985 | Boothe et al. | 24/511 |
| 4,635,836 | 1/1987 | Mooney et al. | 224/247 |
| 4,654,631 | 3/1987 | Kurchart et al. | 340/311.1 |
| 4,741,074 | 5/1988 | Budano, II et al. | 24/3 J |
| 4,797,982 | 1/1989 | Eylers et al. | 24/11 R |
| 4,828,153 | 5/1989 | Guzik et al. | 224/242 |
| 4,903,375 | 2/1990 | DiFranco | 24/3 C |
| 4,944,624 | 7/1990 | Garland | 401/131 |
| 5,008,988 | 4/1991 | Kuhl et al. | 24/510 |
| 5,185,906 | 2/1993 | Brooks | 24/35 |
| 5,280,645 | 1/1994 | Nguyen et al. | 455/274 |
| 5,313,721 | 5/1994 | Filden | 40/1.6 |
| 5,346,784 | 9/1994 | Scheid | 429/98 |
| 5,361,459 | 11/1994 | Hyvonen et al. | 24/35 |
| 5,369,846 | 12/1994 | Suarez et al. | 24/35 |
| 5,379,490 | 1/1995 | Wandt et al. | 24/35 |
| 5,414,596 | 5/1995 | Eaton et al. | 361/814 |
| 5,488,759 | 2/1996 | Lim et al. | 24/3.12 |
| 5,499,429 | 3/1996 | Higginbotham | 24/3.11 |
| 5,528,770 | 6/1996 | Castilla et al. | 455/351 |
| 5,539,417 | 7/1996 | Terry et al. | 343/702 |
| 5,551,069 | 8/1996 | Harrison et al. | 455/90 |
| 5,661,798 | 8/1997 | Chen | 379/454 |
| 5,748,454 | 5/1998 | Nichols et al. | 361/814 |
| 5,829,102 | 11/1998 | Conti | 24/3.12 |

*Primary Examiner*—Don Wong
*Assistant Examiner*—Hoang Nguyen
(74) *Attorney, Agent, or Firm*—Warner Norcross & Judd

(57) ABSTRACT

A pocket clip for an electronic component having an antenna or an antenna shroud. The pocket clip includes a mounting portion adapted to be fitted over the antenna and a finger portion extending from the mounting portion along the housing of the electronic component. In use, the finger cooperates with the housing to pinch or grip the pocket or other structure to which the phone is clipped. In the preferred embodiment, the mounting portion is frictionally fitted over the antenna such that it is easily mounted and removed.

21 Claims, 5 Drawing Sheets

ANTENNA CLIP FOR ELECTRONIC COMPONENTS

BACKGROUND OF THE INVENTION

The invention relates generally to accessories for hand-held electronic devices, such as wireless telephones and two-way radios, and more particularly to a pocket clip for such devices.

Cellular phones come in a variety of sizes and styles. The most recent trend is to minimize the overall size and weight of the phone so it can be easily carried on one's person. One such example of this is the Nokia 5100 series cellular phone. This phone weighs 6 ounces, measures 5.2 inches tall and uses a short ⅝ inch long fixed antenna and shroud. Another example is the Motorola "StarTAC" cellular phone which weighs less than 4 ounces, is made more compact by the use of a hinged housing and telescoping antenna. The housing of the StarTAC phone includes a short fixed support that receives the lower end of the antenna when retracted.

A variety of accessories are available for carrying cellular phones. Belt clip devices, such as described in U.S. Pat. No. 5,361,459 to Hyvonen et al and Nokia's Model BCH-12U, used for the Nokia phone involve attaching a button to the housing of the phone and releasable clip mechanism to a belt. In use, the button is releasably fitted to the clip to secure the phone in place. These and other similar belt clip accessories work well for attaching the phone to a belt but add unwanted bulk and weight that is particularly undesirable when carrying the phone within a shirt or coat pocket. When the phone is not fitted to the clip, the button awkwardly protrudes from the phone and is aesthetically unpleasing to many consumers. Additionally, these belt clips are positioned toward the center of the phone and therefore do not permit the phone to be clipped fully within a pocket. As a result of its central location, the clip gives the phone a top heavy feel when clipped in a pocket.

Another mechanism for attaching a cellular phone to a belt or pocket is described in U.S. Pat. No. 5,551,069 to Harrison et al. Harrison discloses a cellular phone having an antenna that extends along the housing to form a clip. The mechanism suffers from a number of disadvantages. First, because it doubles as the antenna, simultaneously achieving desired design criteria for reception may conflict with styling objectives, economical manufacturing methods or clip performance. For instance, design criteria for the length of the radiating element may be one quarter wave length whereas the styling criteria may not allow this length. Second, the clip is an integral portion of the radiating element and cannot be removed when clipping of the phone is not desired without impacting reception. This also means that the clip is not easily retrofit to existing phones, as it would require replacement of the antenna. Third, the antenna extends along and may be shielded by the phone, potentially interfering with optimal reception. Fourth, this style of phone and antenna does not appear to have met with commercial success nor does it appear to be readily available as an accessory. Currently popular and preferred antennas for style and reception are straight, fixed and less than one and one half inches long or are the straight telescoping style antenna. Other accessories used for carrying cellular phones include neck straps, wrist straps, holsters, and carry bags. However, it is often preferred to carry a cellular phone in a shirt pocket or in an inside coat pocket, yet, there is nothing readily convenient to secure the cellular phone to the pocket to prevent accidentally dropping the phone without the draw backs previously described.

SUMMARY OF THE INVENTION

The aforementioned problems are overcome by the present invention which provides a clip that fixedly or removably mounts to an electronic component, such as a cellular telephone or radio, over a conventional antenna, radiating/receiving element or antenna shroud. The clip includes a mounting portion adapted to be fitted over an antenna, radiating/receiving element or antenna shroud as well as a finger portion extending from the mounting portion adapted to follow the generally contour of the housing of the electronic component.

In a preferred embodiment, the clip is injection molded from plastic and the mounting portion is a generally cylindrical sleeve dimensioned to fitted snuggly over the outer diameter of the antenna or antenna shroud. The finger is a cantilevered element that extends axially from the cylindrical sleeve. The surface of the finger facing the housing is concave and therefore generates two lines of contact pressure that provide enhanced grip on the shirt pocket or other element to which the component is clipped.

The present invention provides a simple and effective clip for electronic components having an antenna or antenna shroud, and in particular for small cellular phones that incorporate a fixed antenna or a telescoping antenna with a fixed portion. In its removable embodiment, the clip is easily attached to and removed from the antenna as desired. Also, the clip is easily retrofit to many existing cellular phones and other electronic components without the need for modification to the component. Further, the antenna clip is relatively small and adds little to the weight and profile of the electronic component. In fact, the weight of the preferred embodiment as adapted for use with a conventional Nokia 5120 phone is approximately two grams and under two millimeters thick. The clip adds no overall width to the phone. The conventional Nokia belt clip system described above weighs approximately twenty grams and adds about nineteen millimeters of width to the phone. Additionally, the clip is easily mass produced using low cost manufacturing techniques, such as injection molding, stamping or the like.

These and other objects, advantages, and features of the invention will be readily understood and appreciated by reference to the detailed description of the preferred embodiment and the drawings.

DETAILED DESCRIPTION OF THE PREFERRED EMBODIMENTS

Figure 1:
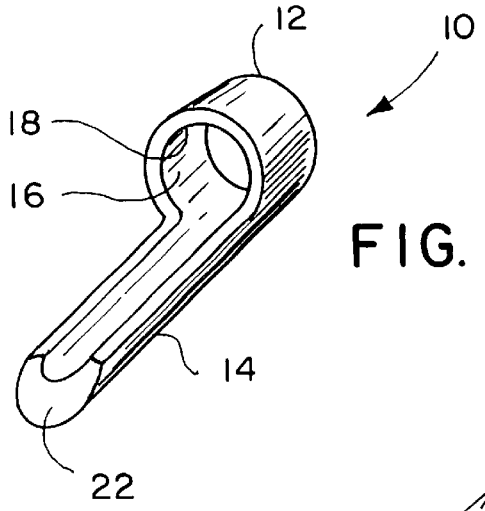
FIG. 1 is a perspective view of a clip according to a preferred embodiment of the invention.

A pocket clip according to a preferred embodiment of the present invention is shown in FIG. 1 and generally designated 10. The clip 10 is adapted to mount over the antenna, radiating/receiving element or antenna shroud of a handheld electronic component, such a wireless phone or radio. For purposes of disclosure, the clip 10 is described in connection with a particular cellular telephone 100. The present invention is, however, well-suited and easily adapted for use with other electronic components, such as, other wireless phones, including cellular phones with fixed antennas or antenna shrouds or with telescopic antennas, having a fixed base portion, and handheld radios including one-way and two-way radios.

Antenna systems are available in a variety of designs. A conventional antenna system includes a radiating/receiving element 74 (see FIGS. 15 and 16) that is electrically connected to the receiver (not shown) and/or transmitter (not shown) of the component. The radiating/receiving element 74 is typically protected within an antenna shroud, for example, a polymeric cap 78. With some components, the component housing includes a fixed support (not shown) that surrounds the base of the antenna. This construction is particularly common with telescopic antennae. With some components having a telescopic antenna, the antenna includes a segment or portion (not shown) that is fixed with respect to the housing. The present invention is readily adapted to mount to an antenna, an antenna shroud, a radiating/receiving element or the like. As used in this application, and particularly in the claims, the term "antenna" refers individually and collectively to a radiating/receiving element, any shroud surrounding the radiating/receiving element, and any fixed portion of or fixed support for a telescoping antenna that is fixed with respect to or protrudes from the main portion of the housing.

Figure 2:
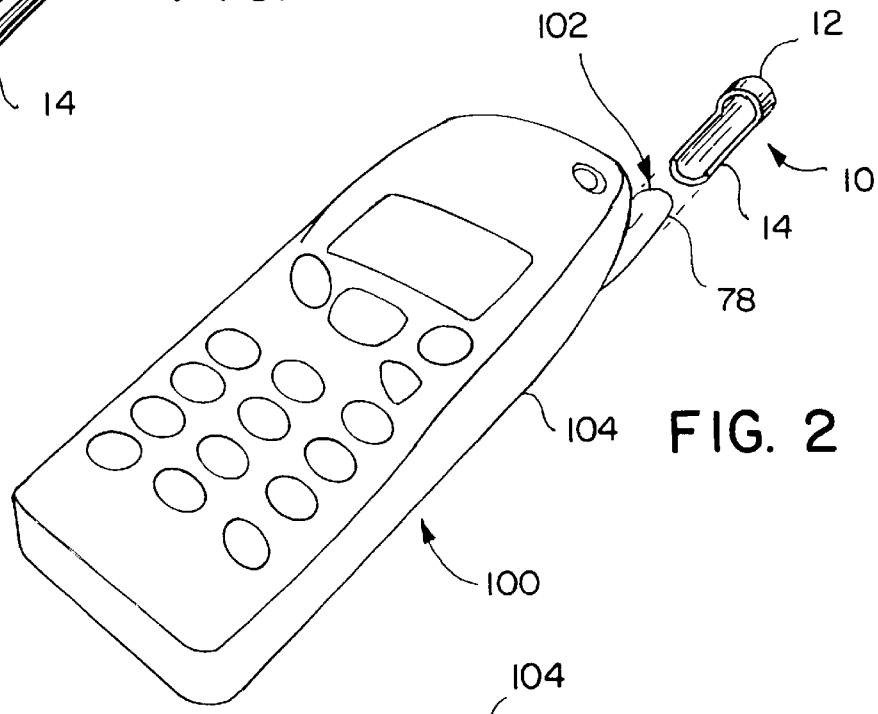
FIG. 2 is a perspective view of the clip shown adjacent to the antenna of a cellular phone.
Figure 3:
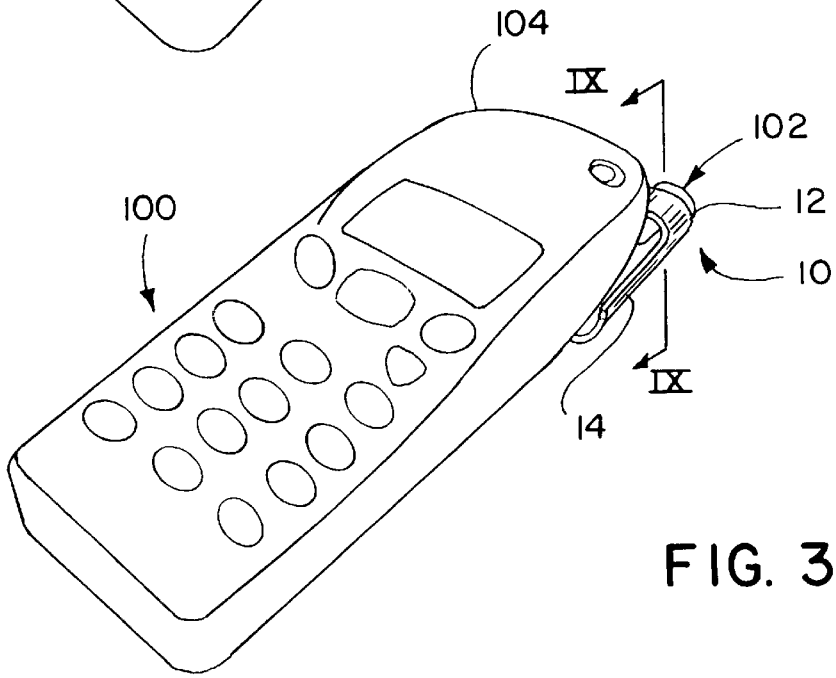
FIG. 3 is a perspective view of the clip mounted over the antenna of a cellular phone.
Figure 4:
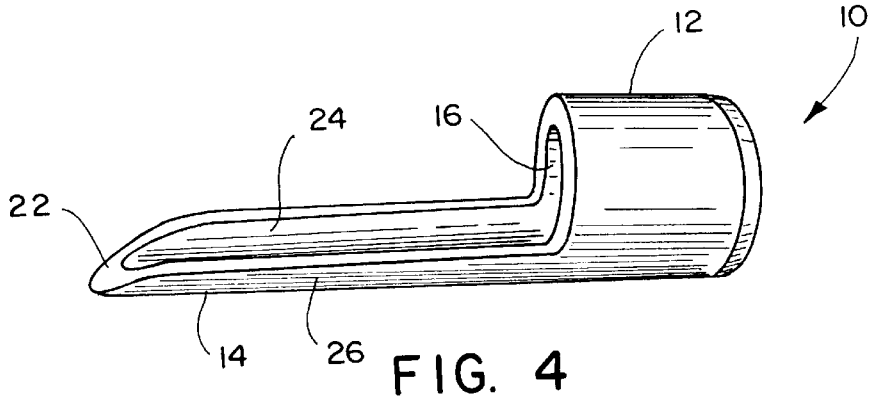
FIG. 4 is front perspective view of the clip.
Figure 5:
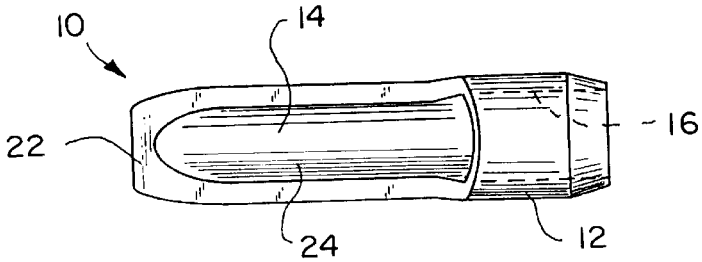
FIG. 5 is a top plan view of the clip.
Figure 8:
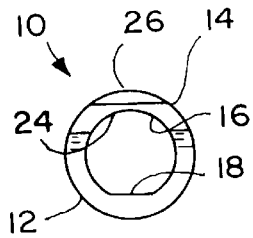
FIG. 8 is a left side elevational view of the clip.
Figure 6:
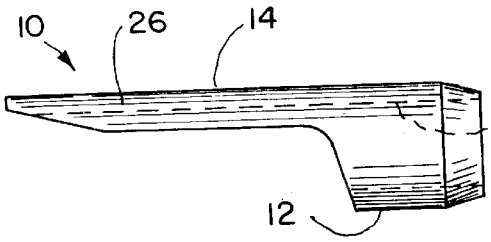
FIG. 6 is a rear elevational view of the clip.
Figure 7:
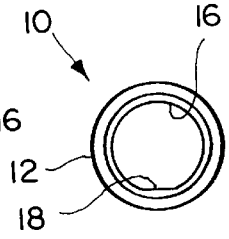
FIG. 7 is a right side elevational view of the clip.
Figure 9:
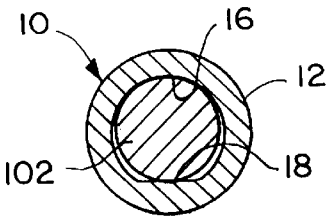
FIG. 9 is a cross sectional view of the clip and the antenna taken along line IX—IX of FIG. 3.
Figure 10:
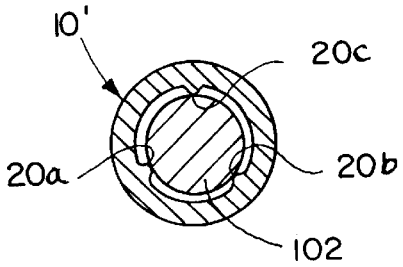
FIG. 10 is a cross sectional view similar to that of FIG. 9 showing an alternative clip.

As shown in FIGS. 2 and 3, the clip 10 is adapted to mount over an antenna 102 of a cellular phone 100. The clip 10 is easily fitted to the antenna 102 when it is desirable to clip the phone 100 in a pocket or other location. The clip 10 can also be easily removed from the antenna 102 when its use is not desired. The clip 10 includes a mounting portion 12 dimensioned to be fitted over the antenna 102 and a finger portion 14 extending from the mounting portion 12 (See FIGS. 4–8). The mounting portion 12 is preferably a cylindrical sleeve defining an internal bore 16 having an internal diameter slightly larger than the external diameter of the antenna 102. The internal bore 16 is primarily circular in cross-section, however, it preferably includes a flat portion 18 that, as shown in FIG. 9, engages the exterior of the antenna 102. The flat portion 18 helps to secure the clip 10 to the antenna by providing an interference fit or frictional fit between the clip 10 and the antenna 102. The internal bore 16 can be provided with other cross-sectional shapes. For example, the internal bore may be fully circular (not shown) or, as shown in FIG. 10, the clip 10' may include a plurality of teeth 20*a–c* that engage the external surface of the antenna 102. The mounting portion 12 will vary in shape and design from application to application depending on the configuration, cross-sectional shape and disposition of the antenna or antenna shroud of the particular component for which the clip is designed. For example, a square mounting portion may be used in applications where the antenna is square.

Figure 11:
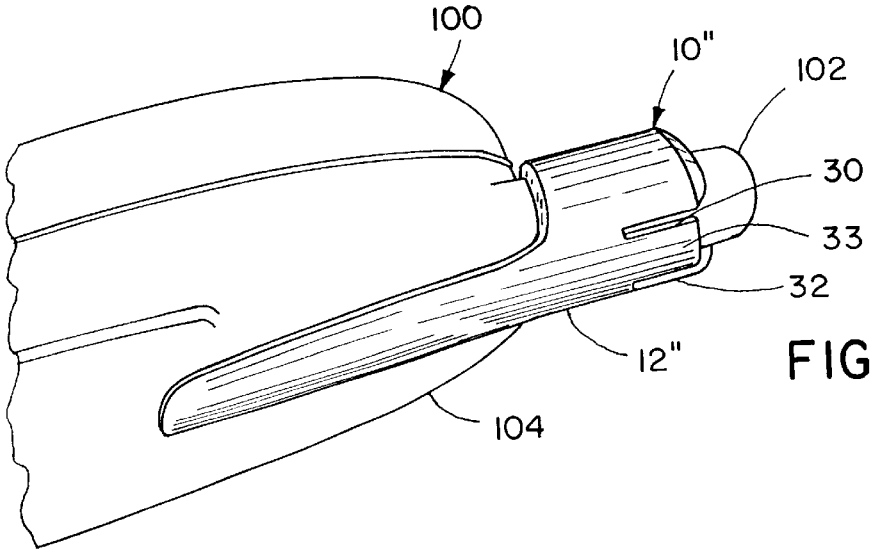
FIG. 11 is a rear perspective view showing a portion of the cellular phone and a second alternative clip mounted over an antenna.
Figure 12:
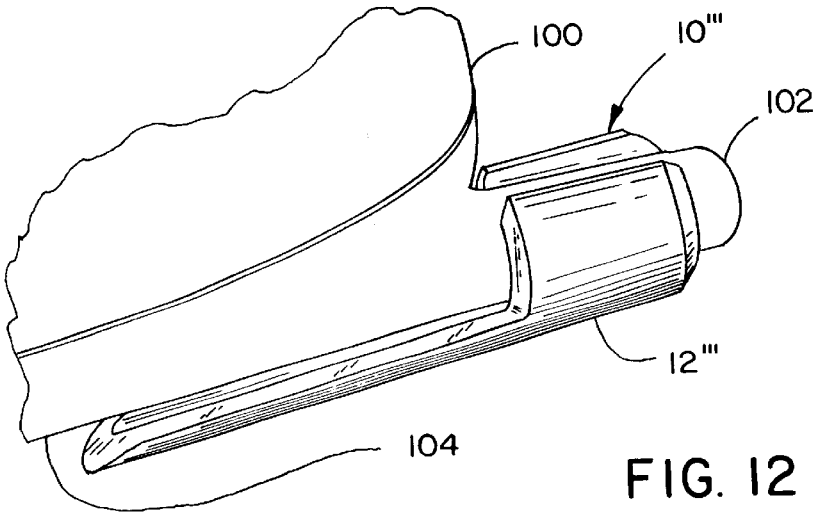
FIG. 12 is a perspective view showing a portion of the cellular phone and a third alternative clip mounted over an antenna.
Figure 13:
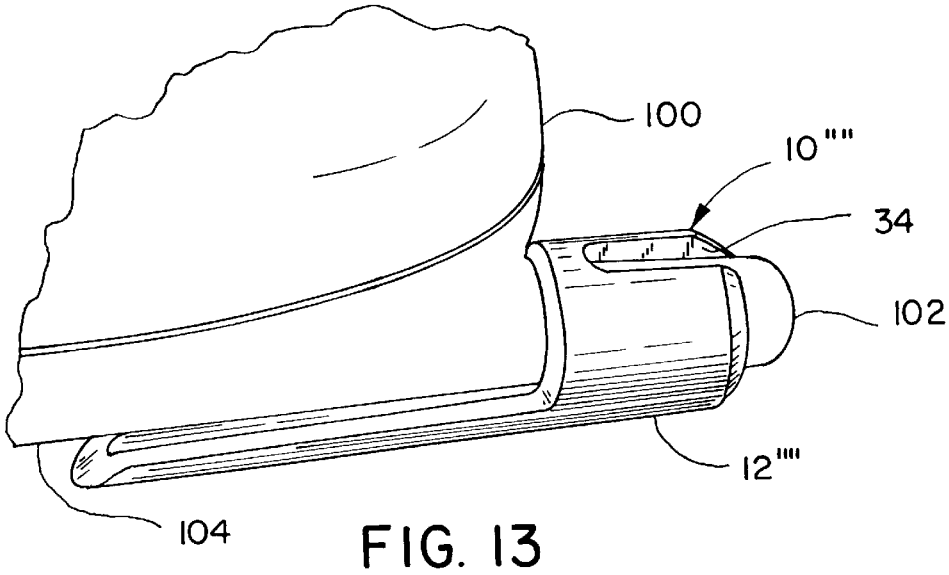
FIG. 13 is a perspective view showing a portion of the cellular phone and a fourth alternative clip mounted over an antenna.
Figure 14:
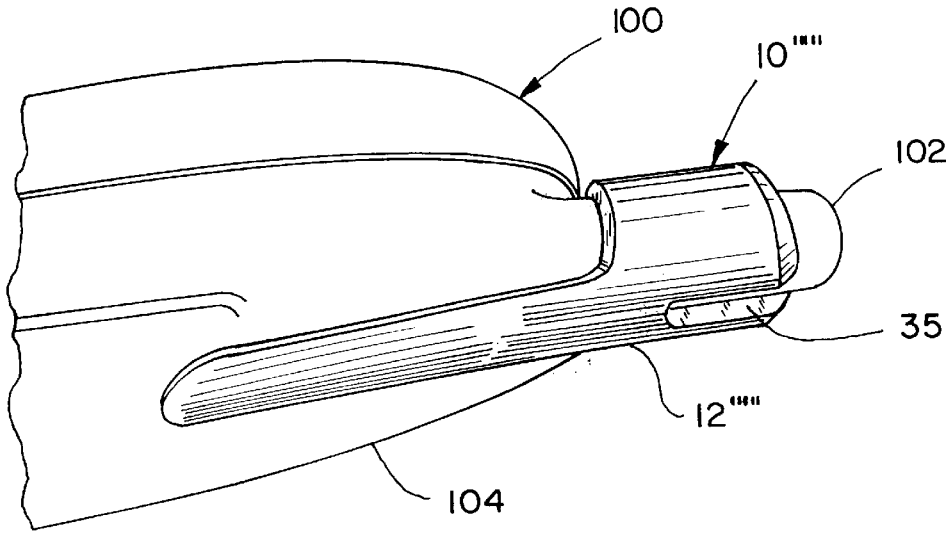
FIG. 14 is a rear perspective view showing a portion of the cellular phone and the fourth alternative clip mounted over an antenna.

Several alternative mounting portions are shown in FIGS. 11–13. In the embodiment shown in FIG. 11, the clip 10" includes a mounting portion 12" that defines a pair of slots 30 and 32 that, in turn, define a tab 33 and provide the mounting portion 12" with a desired degree of flexibility. The number, size and location of slots may vary from application to application depending on the configuration of the mounting portion and the desired degree of flexibility. FIG. 12 shows an alternative embodiment in which the clip 10'" includes a mounting portion 12'" that is split to provide the mounting portion with increased flexibility. The split design may also permit the clip 10'" to be used with antenna having an enlarged end that might prohibit a closed clip from being slid into place on the antenna. FIGS. 13 and 14 illustrates yet another alternative embodiment of the clip 10"" in which the mounting portion 12"" pair relatively wide slots 34 and 35 to again provide flexibility.

The finger 14 extends from the mounting portion 12 along the housing 104 of the phone 100. The finger 14 includes an inner surface 24 and an outer surface 26. The inner surface 24 cooperates with the housing 104 to grab the pocket or other structure to which the phone 100 is clipped. The inner surface 24 is preferably concave such that it provides two lines of contact with the housing 104 and consequently two lines of contact pressure on the pocket or other element to which the phone is clipped. Experience has revealed that this configuration provides improved grip in standard applications. The finger 14 is flexible and is adapted to deflect away from the housing 104 when clipped to clothing, such as a pocket, or to other structures. In the preferred embodiment, the finger 14 extends axially from the cylindrical mounting portion 12 and is tapered at its extreme end 22 to shepherd clothing or other structures into place between the finger 14 and the housing 104. The finger 14 is preferably cantilevered and is shaped to closely follow the contour of the housing 104, thereby reducing the overall profile of the clip 10 and, in turn, the phone 100 when the clip 10 is attached. The shape and configuration of the finger will vary from application to application. For example, the inner surface 24 of the finger 14 may be provided with a knob or with teeth, grooves or other texturing to improve its grip.

Figure 15:
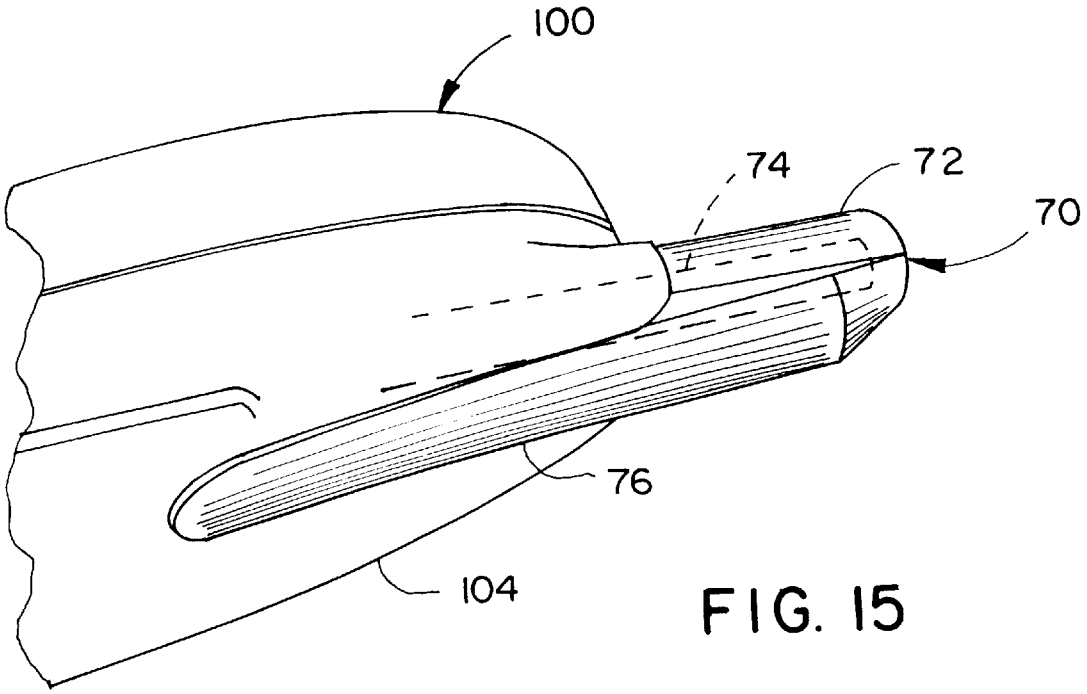
FIG. 15 is a perspective view showing a portion of the cellular phone and a fifth alternative clip fixedly mounted over a radiating/receiving element.
Figure 16:
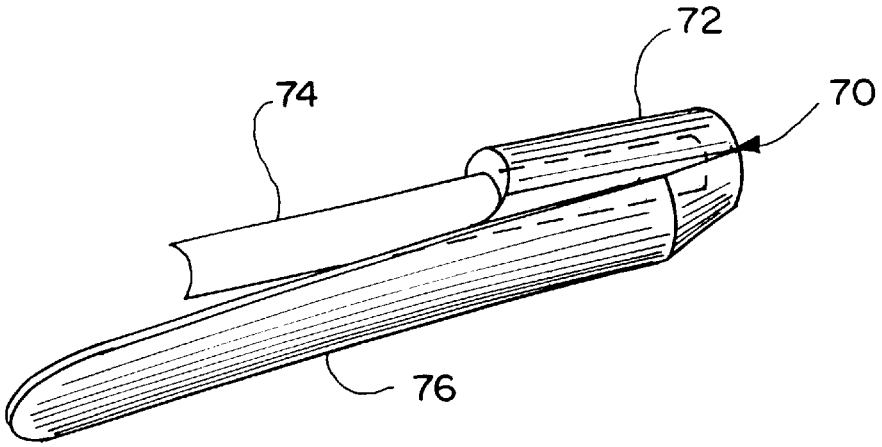
FIG. 16 is a perspective view showing a portion of the radiating/receiving element and the fifth alternative clip mounted to a radiating/receiving element.

As an alternative to the frictional mount described above, the clip can be mounted to the antenna using a variety of other methods. The antenna can be specially configured to snap-fit with the clip through the use of tabs, detents and other similar elements. For example, the antenna may define an annular recess adapted to receive a ring-shaped protrusion extending inwardly from the inner surface of the mounting portion (not shown) or the antenna may include an annular protrusion adapted to snap-fit into an annular recess defined by the inner surface of the mounting portion (not shown). The clip can alternatively be secured to the antenna by a bending moment caused by engagement of the finger with the phone housing. For example, the finger may be configured to engage the housing such that it causes the mounting portion to twist and bind against the antenna. The clip could also be designed as original equipment as opposed to an accessory and fixed to the antenna as shown in FIGS. 15 and 16. This could be achieved by directly molding the clip over the antenna or radiating/receiving element or by the use of the press or snap fits previously described proportioned to resist removal (not shown). In this embodiment, the clip 70 includes a mounting portion 72 that is affixed directly to the radiating/receiving element 74 and a finger 76 that extends from the mounting portion 72 in a cantilevered configuration. The mounting portion 72 defines a void 78 that is fitted over the radiating/receiving element 74.

The clip 10 is preferably manufactured from conventional plastic materials using conventional injection molding techniques and apparatus. The material is preferably selected to permit repeated flexing while remaining firmly attached to the antenna or antenna shroud under moderate force. A wide variety of suitable plastics are well-known to those skilled in the art. The clip 10 can alternatively be manufactured using other conventional material materials and apparatus. For example, the clip 10 can be stamped or otherwise formed from metal.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A clip for an electronic component having a housing with a protruding antenna comprising:

a mounting portion separate from and removably fittable over the antenna;

a finger portion extending from said mounting portion, said finger portion being separate from the antenna and extending along the housing when said clip is mounted to the component, wherein said clip is removably mountable to the electronic component separately from the antenna.

2. The clip of claim 1 wherein said mounting portion defines an aperture fittable over the antenna.

3. The clip of claim 2 wherein said mounting portion is substantially cylindrical sleeve extending along an axis.

4. The clip of claim 3 wherein said finger extends from said mounting portion substantially parallel to said axis.

5. The clip of claim 4 wherein said mounting portion is frictionally interfittable with the antenna, whereby said clip is securable to the antenna by frictional forces.

6. The clip of claim 5 wherein said mounting portion and said finger are integral.

7. The clip of claim 6 wherein said finger is cantilevered from said mounting portion.

8. The clip of claim 7 wherein said finger is flexible and is deflectable away from the housing of the component.

9. A combination comprising:

an electronic component having a housing and a protrusion extending from said housing, said protrusion being further defined as an antenna; and a clip removably mounted to said protrusion, said clip including a mounting portion disposed about said protrusion and a finger extending from said mounting portion along at least a portion of said housing, said finger being flexible and being deflectable away from said housing, whereby said finger and said housing cooperatively define a means for clipping said electronic component.

10. The combination of claim 9 wherein said mounting portion defines an aperture, said aperture fitted over said protrusion.

11. The combination of claim 10, wherein said finger is cantilevered with respect to said mounting portion.

12. The combination of claim 11 wherein said mounting portion is substantially cylindrical sleeve extending along an axis, said sleeve having an internal diameter approximately equal to an outer diameter of said protrusion.

13. The combination of claim 12 wherein said finger extends from said mounting portion substantially parallel to said axis.

14. The combination of claim 13 wherein said mounting portion and said finger are integral.

15. The combination of claim 14 wherein said mounting portion is frictionally interfittable with the antenna, whereby said clip is adapted to be secured to the antenna by frictional forces.

16. A combination comprising:

a cellular telephone including a housing and a fixed antenna protruding from said housing;

a clip removably mounted to said cellular telephone, said clip including a mounting portion disposed about said antenna and a finger portion extending from said mounting portion in a cantilevered configuration, said finger extending adjacent said housing and being flexible whereby said finger is deflectable away from said housing.

17. The combination of claim 16 wherein said mounting portion is a sleeve having an internal surface corresponding in shape with an external surface of said antenna.

18. The combination of claim 17 wherein said mounting portion is frictionally interfitted about said antenna.

19. A combination comprising:

an electronic component having a housing and a radiating/receiving element extending from said housing; and a clip mounted to said radiating/receiving element, said clip including a mounting portion disposed about said radiating/receiving element and a finger extending from said mounting portion along at least a portion of said housing, said finger being flexible and being deflectable away from said housing, whereby said finger and said housing cooperatively define a means for clipping said electronic component.

20. The combination of claim 19 wherein said clip defines a void, said radiating/receiving element fitted within said void.

21. The combination of claim 20 wherein said radiating/receiving element protrudes from said housing in a first direction, said finger being cantilevered with respect to said mounting portion and extending from said mounting portion in a second direction substantially opposite said first direction.

* * * * *